US005661978A

United States Patent [19]

Holmes et al.

[11] Patent Number: 5,661,978

[45] Date of Patent: Sep. 2, 1997

[54] MEDICAL DISPENSING DRAWER AND THERMOELECTRIC DEVICE FOR COOLING THE CONTENTS THEREIN

[75] Inventors: William K. Holmes, San Diego; Laird P. Broadfield, Del Mar, both of Calif.

[73] Assignee: Pyxis Corporation, San Diego, Calif.

[21] Appl. No.: 353,561

[22] Filed: Dec. 9, 1994

[51] Int. Cl.[6] ..... F25B 9/00

[52] U.S. Cl. ..... 62/3.6; 62/277; 62/440; 62/457.1; 62/3.7; 312/209

[58] Field of Search ..... 62/3.2, 3.3, 3.6, 62/440, 441, 449, 452, 304, 272, 277, 457.1; 312/209, 236, 311; 221/69, 122, 12

[56] References Cited

U.S. PATENT DOCUMENTS 3,234,595 2/1966 Weichselbaum et al. ..... 62/3.2
5,014,875 5/1991 McLaughlin et al. ..... 221/69

*Primary Examiner*—John M. Sollecito
*Attorney, Agent, or Firm*—John J. Murphey; Murphey Law Offices

[57] ABSTRACT

A refrigerated, medical dispensing drawer for use in a computerized medicine-dispensing station, the station of the type having a cabinet that houses a plurality of openable drawers in stacked arrangement containing pharmaceutical items in locked storage therein for retrieval following instructions inputted into a computer integrated the station, a drawer including a base plate, spaced-apart side walls, and spaced-apart front and rear walls, all attached together along their respective mating marginal edges to define an interior compartment of a size and shape available for reciprocal movement on a pair of side rails into and out of the cabinet, a tub reposed in the drawer covered by a tub lid hingedly attached to the drawer to form an air-tight chamber interior thereof and moveable with the drawer into and out of the cabinet, a plurality of individual baskets, each formed of fenestrated side walls and a bottom plate joined along their respective mating marginal edges, arranged in the tub with their open tops aligned below like-sized openings formed in the tub lid and covered over with openable basket lids held in locked engagement with the tub lid, and a cooling system powered by a thermoelectric device for cooling the interior and contents of the chamber and maintaining a cool temperature therein, the system completely moveable with the drawer as it is inserted and withdrawn from the cabinet.

33 Claims, 4 Drawing Sheets

FIG 3
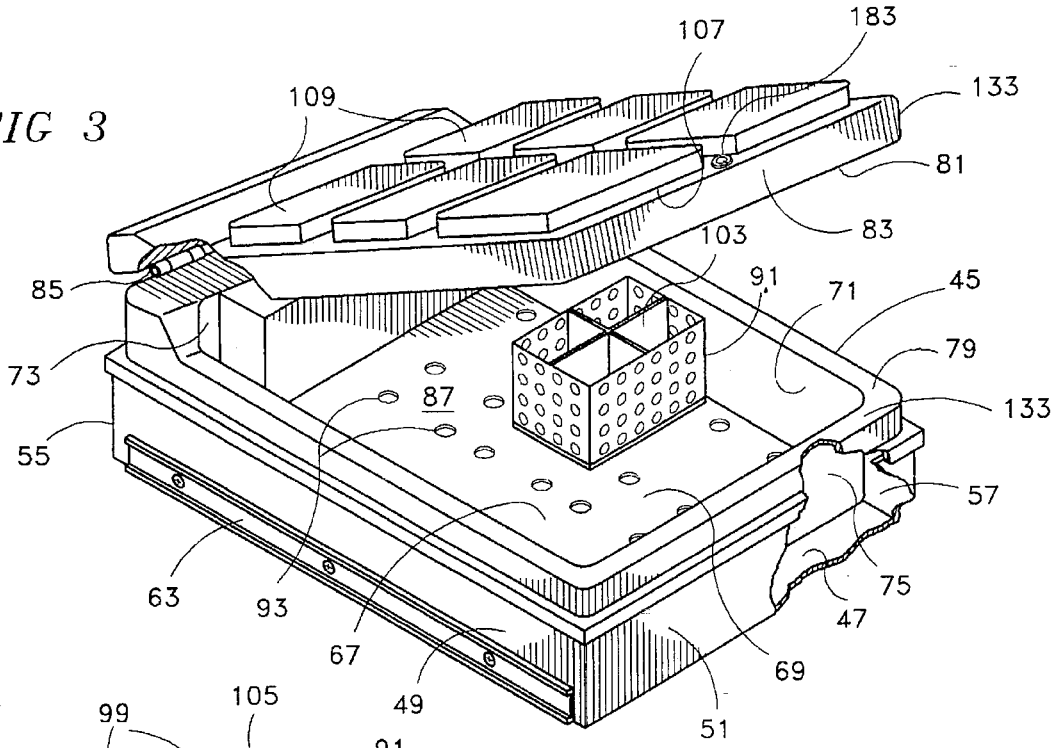
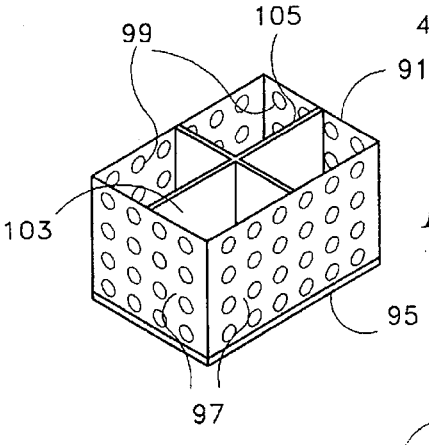
FIG 4
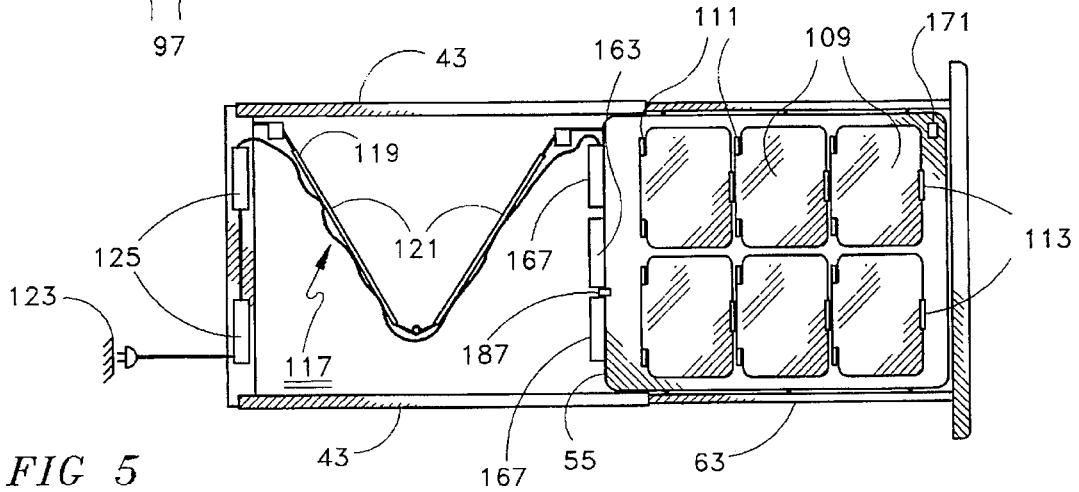
FIG 5

MEDICAL DISPENSING DRAWER AND THERMOELECTRIC DEVICE FOR COOLING THE CONTENTS THEREIN

BACKGROUND OF THE INVENTION

1. Field of the Invention

This invention pertains to the field of dispensing machines. More particularly, this invention pertains to computer-enhanced dispensing machines and to a subassembly for use therein for storing pharmaceutical items at a controlled low temperature for later dispensing to hospital personnel for treatment of a patient.

2. Description of the Prior Art

The art of healing is a wonderfully advancing science. As recent as 50 years ago, most treatment was based upon aspirin, sulfur compounds and lengthy bed rest. Since that time, science has developed antibiotics, pain killers and numerous other medicines that make treatment easier and healing much faster so that now the treatment and healing process takes significantly less time. The result is that more people can be treated in less time, and with better recovery results, than could be accomplished at the end of World War II.

Recently, astonishing discoveries in the field of genetics have identified the cause of many illnesses that have heretofore been thought untreatable and/or incurable. Altering genetic codes to cure or prevent these maladies is now underway and the future is promising to unveil a period when most human suffering will be reduced to virtual non-existence.

In this fast-developing era of advances in medicines, it has become necessary to store certain medicines at lower than room temperature to prolong their active life to allow them to be used over a broader period of time. Without this cool storage, the medicines soon lose their effectiveness and must be replaced. Many of these medicines are expensive and the loss of a single dose through poor storage increases cost of treatment. In addition, to be quite certain of maximizing the effective life of the medicine, the storage must be carefully controlled within strict limits of minimum and maximum temperatures.

Sorrowfully, while these tremendous advancements are taking place in the field of medicine, there seems to be no like improvement in basic human behavior. Drugs, such as pain killers and certain hallucinogenics, used for treating pain as well as certain illnesses such as glaucoma, are the target of dishonest persons who will steal them from pharmacies and medicine-dispensing machines to either use them or sell them for profit to other unfortunates. Other medicines such as those in the genetic field, are so expensive because of the costs of making them, that they are desired by dishonest people who will sell them to the highest bidder. All of this nefarious activity has created a burden to hospitals and other treatment centers to provide costly security and accounting procedures to the handling of many of these medicines.

The prior art has already been introduced to the practice of dispensing pharmaceutical items, such as pre-loaded syringes, ampules of special medicines and other such items from controlled access storage in medication dispenser stations such as that disclosed and claimed in U.S. Pat. No. 5,014,875. This station is a computerized medicine dispenser station of the type having a cabinet that houses a plurality of openable drawers in stacked arrangement containing pharmaceutical items in locked storage therein for retrieval following instructions inputted by treatment personnel to a computer integrated with the station. A control unit on the cabinet is programmed to unlock pharmaceutical-stocked drawers, one at a time, to permit access to the pharmaceuticals with the access being contingent upon keyboard entry of a predetermined access code and other selected information sufficient to generate an access record. The computer inputs also update pharmacy records and generate patient billing accurately reflecting the use of the accessed pharmaceuticals.

The problems encountered in providing controlled cooling to one or more drawers of pharmaceutical items are many and unique. In the first place, the temperature of the air surrounding the pharmaceutical items must be kept at a carefully controlled level so that prolonged opening of the drawer does not result in warming of the items not withdrawn from the drawer. In the second place, access to the entire drawer and its contents must be avoided to prevent a condition where security is breached. Thirdly, moisture should be controlled to prevent damage to the items stored in the drawer. These and other reasons have heretofore prevented the creation of a workable refrigerated drawer.

SUMMARY OF TEE INVENTION

This invention is a refrigerated, medical dispensing drawer for use in a computerized medicine-dispensing station of the type previously described as well as a unique process for cooling the contents therein and maintaining the cool temperature in the drawer while it is opened and closed. The drawer includes a cooling system, powered by a thermoelectric device, that is totally moveable with the drawer so that the system remains working whether the drawer is closed in the cabinet or opened therefrom. In addition, the cooling system utilizes a closed loop of air in the drawer so that little or no ambient air is allowed to enter and bring in unwanted moisture and further add an energy load to the cooling system. Further, the cooling system provides a unique method of eliminating moisture from inside the drawer and exhausting it to the atmosphere without putting it in contact with surrounding electronic controls.

The inventive process includes a means of drawing heat from the inside of the drawer through the thermoelectric device without the use of chlorinated fluorocarbons and other deleterious compounds. Further, the process provides uniform distribution of cooling air evenly over the contents in the drawer to promote even cooling of all items stored therein. Still further, the process provides a unique method of measuring the voltage value of the thermoelectric device to determine the temperature of the cold side of the device. This value is vital to the proper control of the temperature in the drawer.

Accordingly, the main object of this invention is a refrigerated, medicine-dispensing drawer for use in a computerized medicine-dispensing station that has its cooling system attached to the drawer and moveable therewith so that there is positive cooling in any position the drawer takes in the cabinet. Other objects of this invention include a refrigerated, medicine-dispensing drawer wherein the cooling system utilizes a closed loop of coolant air in the drawer, to keep out unwanted moisture; a cooling system that provides a unique method of eliminating moisture from the drawer and passing it into the surrounding air apart from the electronic controls of the cabinet; a process of cooling that provides uniform distribution of cooling air over the contents in the drawer, and, a method of providing cooling to various pharmaceutical items without breaching the security that is made a part of the entire station.

These and other objects will become more apparent when reading the following Description of the Preferred Embodiments taken together with the drawings that are appended hereto. The scope of protection desired by the inventors may be gleaned from a fair reading of the claims that conclude this specification.

DESCRIPTION OF THE DRAWINGS

FIG. 3 is a trimetric illustrative view of the preferred embodiment of the drawer of this invention showing the tub lid raised and a basket located therein;

FIG. 4 is a perspective view of a basket that is used in the drawer;

FIG. 5 is a top plan view of the drawer pulled from the cabinet showing the trolley and the basket covering lids;

DESCRIPTION OF THE PREFERRED EMBODIMENTS

Figure 1:
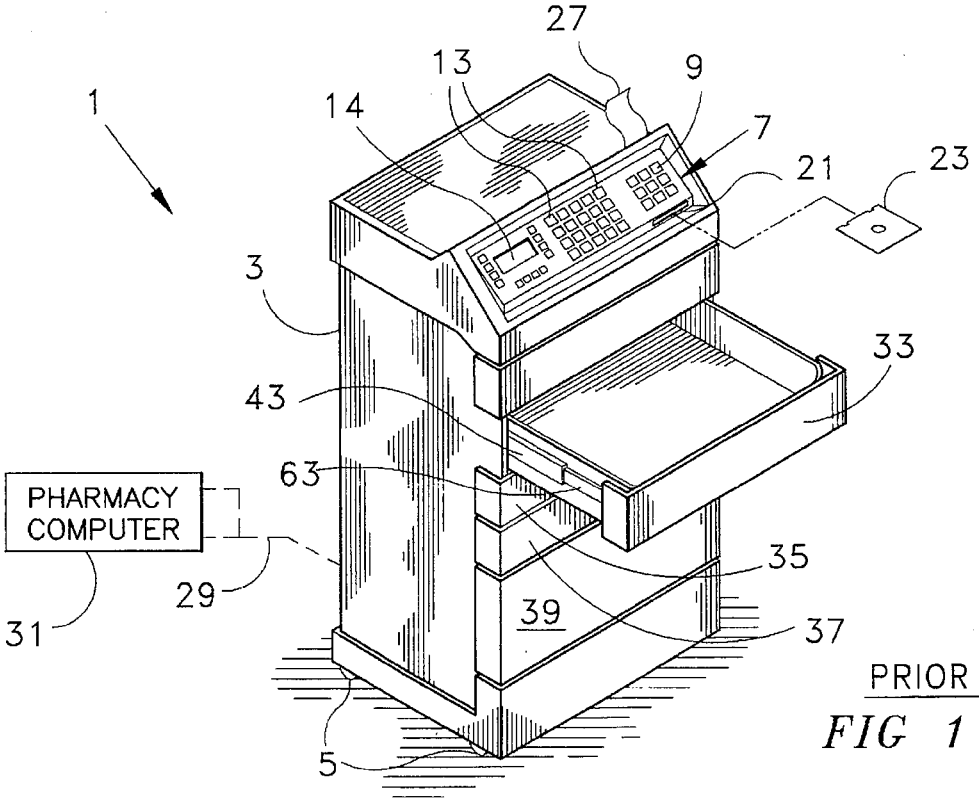
PRIOR ART FIG 1
FIG. 1 is a trimetric illustrative view of the computer-enhanced medicine dispenser station of the prior art and to which this drawer is useful.

Turning now to the drawings where like elements are identified with like numbers throughout the nine figures, FIG. 1 shows the typical prior art dispenser station 1 comprising a compact cabinet 3 which may be supported on wheels 5 for convenient portability. A control unit 7, designed for relatively quick and easy access and relatively simple keyboard entry of appropriate predetermined authorization access codes and other information, is mounted generally within the upper extent of cabinet 3 and includes a keyboard 9. Said keyboard includes an array of keys 13 or similar entry devices for entering information, in conjunction with a display which utilizes liquid crystal elements or the like in programmed interaction with entered information.

Figure 2:
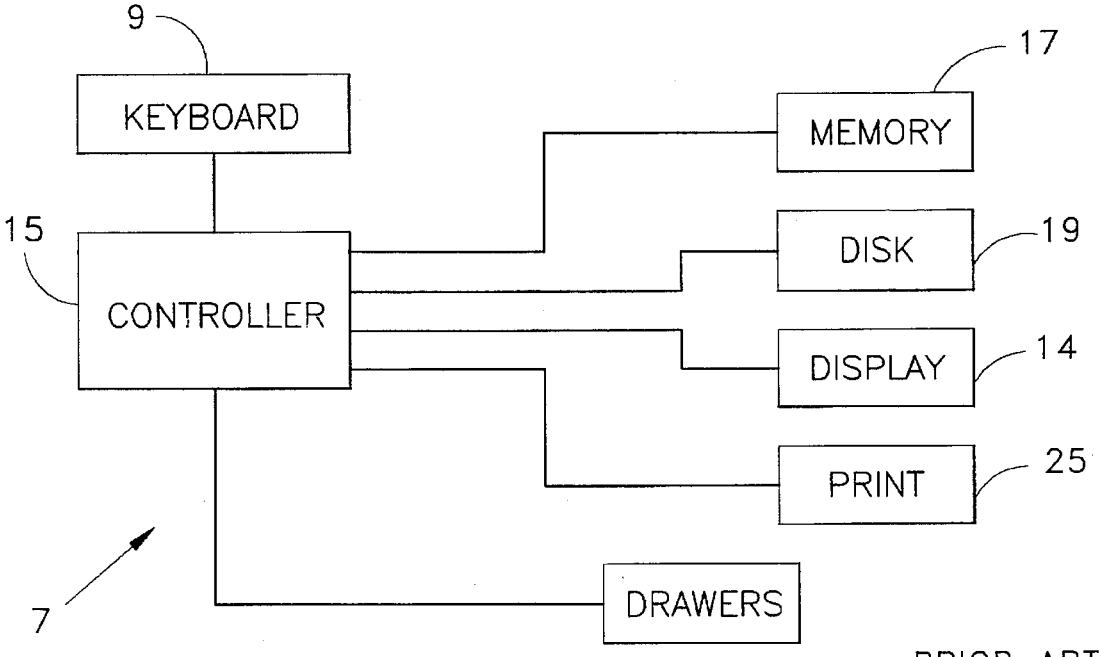
PRIOR ART FIG 2
FIG. 2 is a schematic diagram of the activity of the components is the use of the station shown in FIG. 1.

FIG. 2 depicts a controller unit in schematic form with keyboard 9 for information to a controller 15. Controller 15 is programmed to regulate access to the station drawers, and to generate an access record which is stored in an internal memory 17, or recorded via a disk drive 19 having an exposed disk port 21 to receive a conventional disk 23 (see FIG. 1). Alternately, the access record can be displayed on the cabinet display 14 and/or otherwise printed by means of an integral printer unit 25 for appropriate printout onto paper tape 27 (see also FIG. 1).

The control unit 7 is preprogrammed with appropriate information regarding the medication types associated with a group of controller assigned to dispenser station 1. In a preferred form, this preprogramming occurs by virtue of a data link 29 which interconnects station 1 to a main computer such as a pharmacy computer 31 (see FIG. 1) of the type used commonly in a centralized hospital pharmacy to track patient requirements for medication and other pharmaceutical items. In this regard, pharmacy computer 31 desirably includes appropriate software for programming and updating a group of dispenser stations located at centralized sites throughout a hospital facility thereby permitting regular updating of each dispenser station according to the most current patient information.

As shown in FIG. 1, dispenser station 1 includes a stack of four drawers labelled 33, 35, 37 and 39. Upper drawer 33 has a generally conventional drawer geometry and is mounted on slides 43 for opening movement with respect to station housing 3. The drawer of this invention usually takes the place of two drawers such as 33 and 35, 35 and 37, or 37 and 39.

As shown in FIG. 3, the drawer 45 of this invention is made up primarily of a base plate 47 extending along the bottom of the drawer and terminated by a pair of upstanding, spaced-apart vertical side walls 49, a vertical front wall 51 and a vertical rear wall 55 all joined along their intersecting marginal edges. Rear wall 55 is inset from the rear of the overall drawer for reasons to be explained later. Base plate 47, side walls 49, front wall 51 and rear wall 55 define an open topped interior compartment 57 of the general size and overall shape of a typical drawer 35 through 39 (and, preferably twice the height) usable in dispenser station 1. Its size and shape allows it to be supported on slides 43 having one piece attached to the interior wall (not shown) of cabinet 1 and the other piece 63 attached laterally along the outside of side walls 49 for sliding intermovement therebetween.

A tub 67, having a base 69, a pair of spaced-apart upstanding side walls 71, an upstanding rear wall 73 and an upstanding front wall 75 spaced-apart therefrom, said base and all said walls joined together along their respective intersecting marginal edges, reposes in compartment 57 and forms the bottom of the drawer wherein pharmaceutical items will be stored and cooled. The top marginal edges 79 of tub 67 form a rather broad sealing surface adapted to receive thereon the marginal edge 81 of a tub lid 83 that is attached, preferably by hinges 85, to drawer 45 to form an air-tight chamber 87 interior thereof and of a size that allows chamber 87 to be moved into cabinet station 1 and pulled outward therefrom.

At least one, but preferably a plurality of individual baskets 91 are placed in tub 67, preferably in indentations 93 formed in tub base 69 for holding the individual pharmaceutical items therein. As shown in FIG. 4, baskets 91 are each preferably formed of a rectangular base or bottom plate 95 that is joined along its respective four marginal edges with upstanding side walls 97, that form a series of openings or other fenestrations 99, and that form an open top 103. Dividers 105 may be utilized in one or more baskets in the event of certain circumstances, such as when the item to be stored is quite small and different ones contain different doses, etc. Fenestrated side walls 97 form an open top to basket 91 that is aligned below like-size openings 107 formed in tub lid 83.

At least one but preferably a plurality of basket lids 109 are connected to tub lid 83 and positioned, such as by hinges 111, one over each openings 107 for providing access to each basket. A series of individual locks 113 are provided, one to each basket, for security of the interior of the baskets. Locks 113 are controlled by control unit 7 to permit access to the interior of each basket.

Figure 6:
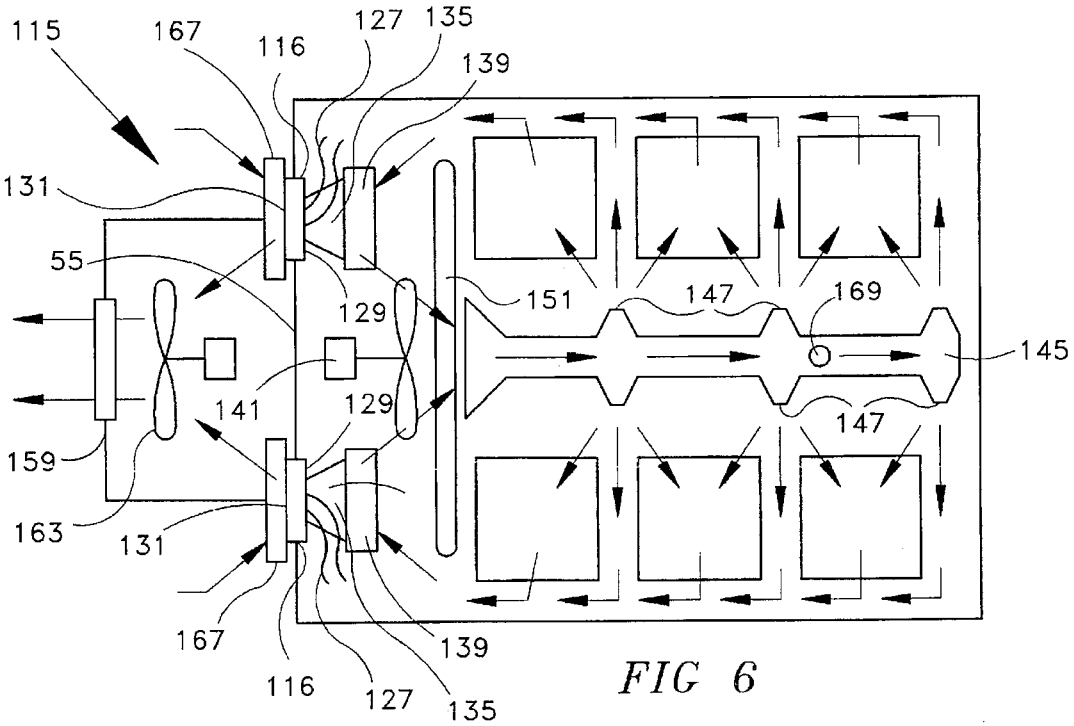
FIG. 6 is a schematic view of the top of the drawer of the invention showing the air flow through the drawer.
Figure 7:
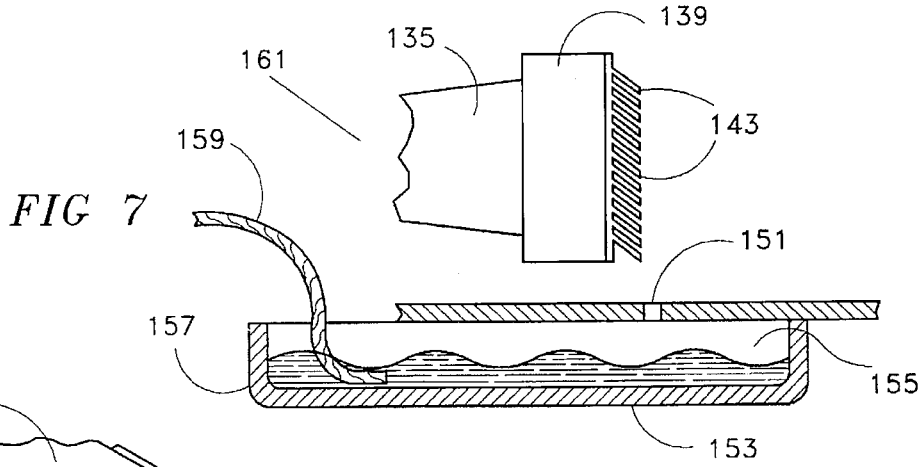
FIG. 7 is a side illustrative view of the special design of the cold sink fins and the means for recovering the condensate from inside the chamber.

As shown in FIGS. 5 and 6, a cooling system 115 is provided to cool chamber 87 and maintain a steady temperature therein, even during opening and closing of drawer 45 in housing 3. The first item of importance in cooling system 115 is that it is mounted on drawer rear wall 55 and provided with means 117 to allow it to remain functional notwithstanding the opening and closing of drawer 45. This is mainly accomplished by powering system 115 with a thermoelectric (TE) device 116 and transfer means such as a power cable trolley 119 made up of articulating arms 121 that allow the electric power cable to move freely when drawer 45 is opened and closed. As shown in FIGS. 6 and 7 TE device 116 is a rather thin electronic chip, some of them incorporating a Piezo electric crystal, to which a direct electrical current (dc) is impressed from an external power source 123 (see FIG. 5) through a control circuit 125 to wires 127 leading into the device. Device 117 thereafter forms a cold face 129 and a hot face 131 in spaced-apart relations whereupon ambient energy is transferred from cold face 129 to hot face 131. By arranging cold face 129 to interface with the interior of chamber 87 and expose hot face 131 to the atmosphere, heat energy in the air in chamber 87 will be drawn out through TE device 117 and exhausted to the atmosphere.

Heat insulation 133 (see FIG. 3) is provided between tub 67 and compartment 57, including between the side walls and front walls, to reduce the flow of heat into chamber 87. Similar insulation is provided in tub lid 83 and basket lids 109. FIG. 7 shows the preferred embodiment of cooling system 115. With the outside of drawer 45 being about 24 inches long and about 18 inches wide, two TE devices 117 are used and are shown mounted in spaced-apart relationship in drawer rear wall 55 with their respective cold faces 129 facing inward toward air-tight chamber 87. A cold funnel 135 extends from each cold face 129 interior chamber 87 and terminates at a cold sink 139. Cold funnel 135 comprises a solid piece of highly heat conductive material, such as aluminum, and is provided for the purpose of transmitting heat energy from cold sink 139 to cold face 129. Cold sink 139 is a finned heat exchanger, made of highly heat conductive material, also such as aluminum, over which air, circulated through chamber 87, is passed to draw out its heat energy for passage through cold funnel 135 and on to TE device cold face 129.

A fan 141 is located interior of cold sink 139 and draws air from cold sink 139 for movement over the items stored in baskets 91. This part of the cooling system is quite unique in that the fins 143 on cold sink 139 are arranged with fan 141 to draw air laterally along and over said fins to provide a longer repose or contact time with cold sink 139 and more efficient transfer of heat from the air to cold sink 139 than to just blast the air against the fins such as is done in the prior art.

A central duct 145 is provided as shown to convey the cold air from fan 141 centrally through air-tight chamber 87 for equal dispersal from vents 147 formed is said duct. As shown by the flow arrows, this cold air passes through fenestrations 99 formed in basket walls 97 and over the pharmaceutical items formed therein to cool them. Upon reaching the outer walls of chamber 87, the air is drawn by fan 141 back toward cold sink 139 to give up its heat before being recirculated through chamber 87. This control of the flow of cold air through the baskets and over the items stored therein precludes the formation of warm spots in chamber 87 and insures that all items are maintained at one temperature.

After the cold air passes through baskets 91 and flow outward to the outside of chamber 87, it is drawn by fan 141 back to cold sink 139. A further unique method of cooling this air is to draw it along the length of fins 143 so as to increase its residence time and provides the maximum time and opportunity to give up its heat to said cold sink. After said air passes along said fins, it once again is introduced to the blades of fan 141 to start its journey back into central duct 145.

As shown in FIG. 7, fins 143 are arranged in a novel manner on cold sink 139. As shown, they are slanted downward from the horizontal so that any moisture condensed thereon during the cooling process runs under gravitational forces to the front of the fins and, when enough is collected to overcome the surface tension of the water, drips downward. In the bottom of tub 67 is formed a small aperture (slit) 151, passing along the outer edge of the bottom fin of fins 143 and opening through tub 67. Below said slit is positioned a collecting vessel 153 forming a hollow chamber 155 therein into which the condensed moisture drips under gravitational forces. Vessel 153 has a portion 157 extending rearward, under tub 67, and out under TE device hot face 131. A cloth wick 159 is positioned in chamber 155 and extends upward into the warm air plenum 161 formed around another fan 163 that draws ambient air across the fins 165 that are made part of a finned hot sink 167 and used to cool sink 167 and disperse the heat energy drawn from inside chamber 87 during the cooling process. In addition, fins 165 are also arranged laterally and ambient air drawn laterally along and across said fins to increase the residence time therebetween and make the heat transfer operation for efficient. The hot air facilitates evaporation of condensate from wick 159.

Figure 8:
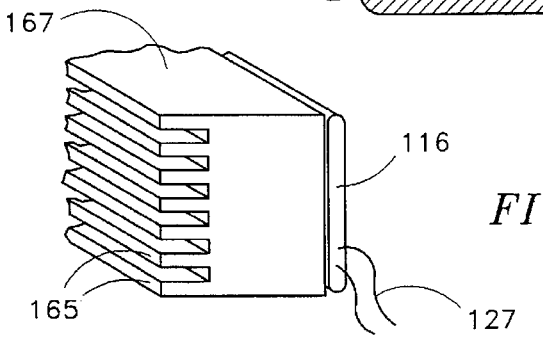
FIG. 8 is a trimetric illustrative view of the heat sink attached to the hot face of the thermoelectric device; and, FIG. 9 is a rear elevational view of the novel baffle that is used in this invention.

It is vital to the extended life of the medicines stored in chamber 87 that the temperature remains closely controlled between two narrow temperatures, such as 38° F. and 42° F. It is further very important that cold sink 139 never reach the temperature of 32° F. or below. The reason for this is that condensation will freeze at 32° F. and below, building up on fins 143, and either break off to hamper further storage operations or melt to form a puddle on the floor of tub 67 thereby making the pharmaceuticals stored therein wet and subject to bacterial growth. A first temperature monitor probe 169 is mounted in central duct 145 to continuously monitor the temperature of the cold (coldest) air coming directly from fan 141. A temperature readout 171 is provided, as shown in FIG. 8, that is mounted near the front of drawer 45 so that anyone using said drawer can visually monitor the temperature of the contents of tub 67.

Another unique aspect of this invention is that the power to TE device 116 is periodically turned off and the thermistor measured to determine the exact temperature of cold sink 139. The turn-off period is measured in micro-seconds so that there is no substantial interruption in the power to TE device 117. It is important to maintain the TE device at no less than 32.5° F. so that cooling is maximized without allowing any frost to build up in the unit. Further, the process includes turning off the power to TE device 117 for a few minutes periodically as secondary protection to prevent any internal frost buildup from occurring.

Figure 9:
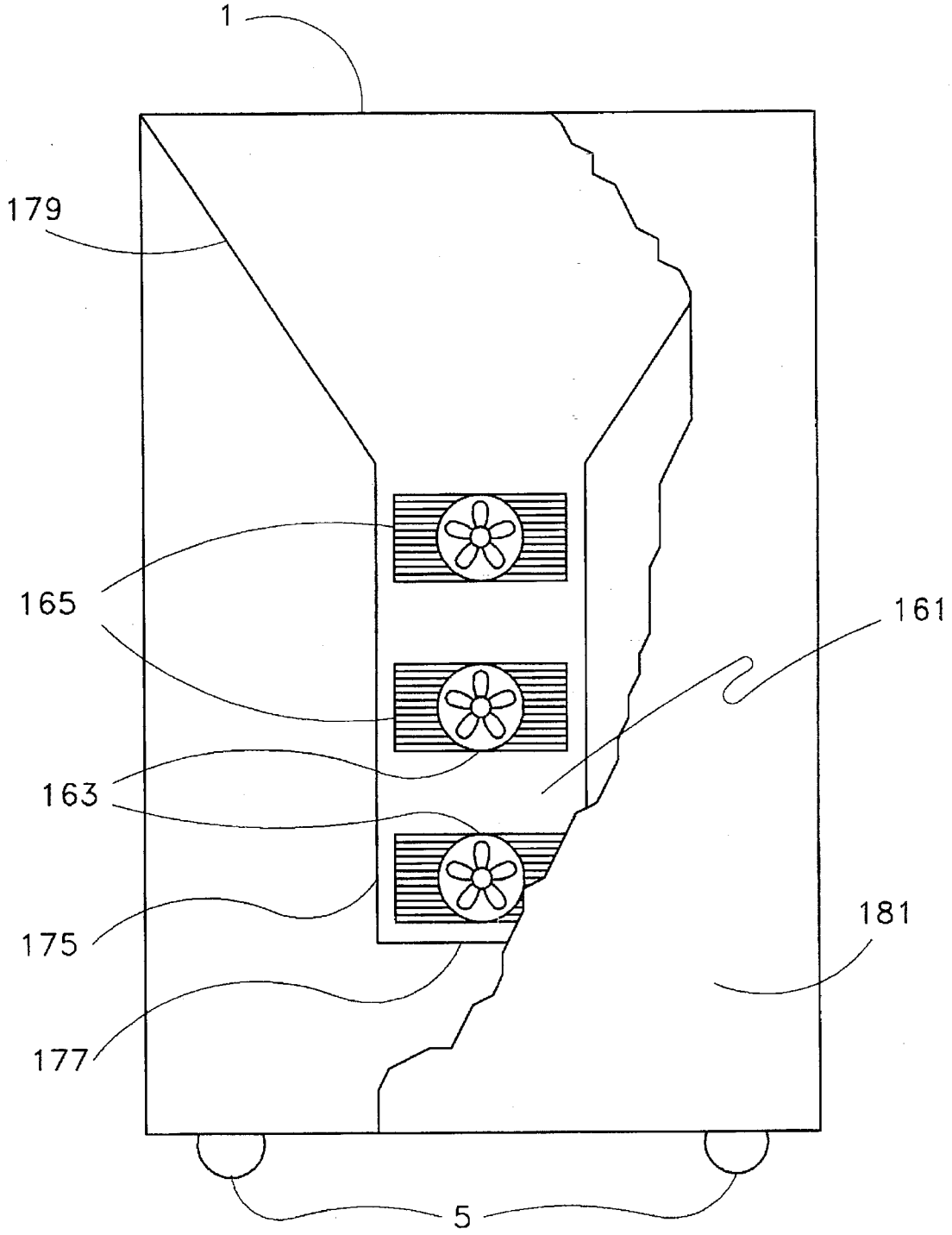

It is important not to introduce the moisture and/or the hot air from hot sink 167 to the electronic circuitry and other controls located at the rear of station 1. Both moisture and hot air cause deterioration of the separate components and shorten the life of the unit. As shown in FIG. 9, a unique baffle 175 is formed at the rear of station 1 to utilize the coolest air surrounding station 1 as a heat transfer medium in cooling hot sink 167.

As shown in FIG. 9, baffle 175 comprises a short, lateral base wall 177, extending outward from the rear surface of station 1, that is located inboard of fins 165 and below fan 163. A pair of spaced-apart, upstanding baffle side walls 179 are connected to the terminal ends of base wall 177 and extend, in divergent directions upward from base wall toward the top of station 1. It is preferred that, at or near the top exhaust fan, side walls 179 bend further outward in an increasing divergent manner as shown. A cover plate 181 is placed over bottom wall 177 and side walls 179 to contain the heated air and exhaust it upward.

Ambient air from the floor area and near the floor on which station 1 is standing, is drawn into fins 165 and therealong to cool said fins and hot sink 167. This air is captured within baffle walls 177, 179 and cover plate 181 and exhausted upward, out of contact with the electronic controls at the rear of the drawers in station 1. The moisture introduced into this exhaust air stream by wick 159 is also kept apart from the electronics.

A lock 183 (see FIG. 3) is provided in tub lid 83 to maintain security of chamber 87. It is openable for restocking baskets 91 and to clean the unit. In the event of a total power failure, a mechanical latch 187 (see FIG. 5) is operable at the rear of station 1 to allow drawer 45 to be pulled outward from its closed position. Lock 183 is then unlocked and lid 83 is liftable to expose all the contents in said baskets.

In operation, the user inputs coded information into control unit 7 via keyboard 9 that includes the identification of the user, the patient, the doctor and the medicine prescribed for the patient. Upon verification of the data, drawer 45 unlatches and is pulled outward to expose the lid-covered baskets. The specific basket lid 109 becomes electrically unlatched and the user may lift or open the lid and extract the specific medicine to be used. The computer simultaneously adjusts the pharmacy computer, to show a reduction in inventory of that particular medicine, and the patient's billing is automatically credited with the medicine.

A specific benefit to this system is that the cold air in tub 67 is heavier than the warmer, ambient surrounding air and it tends to remain in tub 67 even when one of the basket lids is opened and a vial of medicine is extracted therefrom. Since this cold, heavy air is captured in sub 67, it will stay therein, even when one of the basket lids are opened. Therefore, there is little loss of cold air and cooling system 117 is not overstressed after drawer 45 is shut down.

While this invention has been described with respect to a particular embodiment, it is not to be considered as restricted to it. All combinations of elements that perform the same function in substantially the same way to produce substantially the same result are considered within the scope of this invention.

What is claimed is:

1. A refrigerated, medical dispensing drawer for use in a computerized medicine-dispensing station, said station of the type having a cabinet that houses a plurality of openable drawers in stacked arrangement containing pharmaceutical items in locked storage therein for retrieval following instructions inputted into a computer integrated the station, said drawer comprising:

a) a drawer including a base plate, spaced-apart side walls, and spaced-apart front and rear walls, all attached together along their respective mating marginal edges to define an interior compartment of a size and shape available for reciprocal movement on a pair of side rails into and out of the cabinet;

b) a tub reposed in said drawer covered by a tub lid hingedly attached to said drawer to form an air-tight chamber interior thereof and moveable with said drawer into and out of the cabinet;

c) at least one basket, formed with fenestrated side walls and a bottom plate joined along their respective mating marginal edges, arranged in said tub with its open top aligned below a like-sized opening formed in said tub lid and covered over with an openable basket lid held in locked engagement with said tub lid; and, d) a cooling system powered by a thermoelectric device for cooling the interior and contents of said chamber and maintaining a cool temperature therein, said system completely moveable with said drawer as it is inserted and withdrawn from the cabinet.

2. The refrigerated, medical dispensing drawer of claim 1 further including a plurality of individual baskets, each formed with fenestrated side walls and a bottom plate joined along their respective mating marginal edges, arranged in said tub with their open tops aligned below like-sized openings formed in said tub lid and covered over with openable basket lids held in locked engagement with said tub lid.

3. The refrigerated, medical dispensing drawer of claim 1 further including:

a) a cold funnel attached to the cold face of the thermoelectric device and extending inward to said chamber;

b) a cold sink attached to said cold funnel and including fins extending outward therefrom; and, c) a fan located interior said chamber for blowing air laterally across said fins to transfer heat to said cold sink.

4. The refrigerated, medical dispensing drawer of claim 1 further including a central duct having openings formed in spaced relationship along the sides thereof for passing a stream of air centrally inside said chamber.

5. The refrigerated, medical dispensing drawer of claim 1 wherein said cooling system recirculates the air inside said chamber and does not draw in ambient air.

6. The refrigerated, medical dispensing drawer of claim 3 wherein said fins are sloped downward to guide condensate formed thereon by gravity to the bottom of said tub.

7. The refrigerated, medical dispensing drawer of claim 1 including two thermoelectric devices mounted in spaced-apart relationship on said rear wall of said drawer.

8. The refrigerated, medical dispensing drawer of claim 1 further including a finned air heat exchanger connected to said hot face of said thermoelectric device and extending outward from said rear wall.

9. The refrigerated, medical dispensing drawer of claim 8 further including:

a) a fan to direct a flow of ambient air against said heat exchanger: and, b) a duct to guide the air drawn in by the fan along said fins of said heat exchanger to increase the residence time thereagainst and promote a greater transfer of heat thereto.

10. The refrigerated, medical dispensing drawer of claim 1 wherein said tub is defined by a base surrounded by a pair of spaced-apart, upstanding side walls an upstanding rear wall and an upstanding front wall spaced-apart therefrom, said walls joined together along their respective intersecting marginal edges, and said cooling system further includes:

a) an aperture formed in said base of said tub below said cold sink, said aperture leading outward therefrom; and, b) a liquid collecting vessel located below said aperture for receiving condensed water falling through said slot from said cold sink.

11. The refrigerated, medical dispensing drawer of claim 10 further including:

a) a portion of said vessel extending rearward under said tub and out under said thermoelectric device; and, b) a wick extending from said vessel upwards into said warm air stream emanating from said hot face of said thermoelectric device to remove the condensate from said vessel by evaporation.

12. The refrigerated, medical dispensing drawer of claim 1 further including a baffle to remove the hot, moisture laden air from the hot face of said thermoelectric device, said baffle comprising:

a) a short, lateral base wall extending outward from the rear surface of said station and located inboard of said heat exchanger fins;

b) a pair of spaced-apart, upstanding baffle side walls connected to the terminal ends of said base wall and extending in divergent directions upward from said base wall toward the top of said station; and, c) a plate covering over said base wall and said side walls to form an enclosed duct with an open top for venting air therefrom.

13. A refrigerated, medical dispensing drawer for use in a computerized medicine-dispensing station, said station of the type having a cabinet that houses a plurality of openable drawers in stacked arrangement containing pharmaceutical items in locked storage therein for retrieval following instructions inputted into a computer integrated the station, said drawer comprising:

a) a drawer including a base plate, spaced-apart side walls, and spaced-apart front and rear walls, all attached together along their respective mating marginal edges to define an interior compartment of a size and shape available for reciprocal movement on a pair of side rails into and out of the cabinet;

b) a tub reposed in said drawer covered by a tub lid hingedly attached to said drawer to form an air-tight chamber interior thereof and moveable with said drawer into and out of the cabinet;

c) a plurality of individual baskets, each formed of fenestrated side walls and a bottom plate joined along their respective mating marginal edges, arranged in said tub with their open tops aligned below like-sized openings formed in said tub lid and covered over with openable basket lids held in locked engagement with said tub lid; and, d) a cooling system powered by a thermoelectric device for cooling the interior and contents of said chamber and maintaining a cool temperature therein, said system completely moveable with said drawer as it is inserted and withdrawn from the cabinet; and, e) a trolley extending from the rear of said station to said drawer rear wall having articulating arms interengaged therewith for carrying and directing electrical and electronic lines from the rear of said station to said cooling system during its travel into and out of said cabinet;

f) said cooling system utilizing a totally recirculated stream of cool air without the introduction of ambient air.

14. The refrigerated, medical dispensing drawer of claim 13 further including:

a) a cold funnel attached to the cold face of the thermoelectric device and extending inward to said chamber;

b) a cold sink attached to said cold funnel and including fins extending outward therefrom; and, c) a fan located interior said chamber for blowing air laterally across said fins to transfer heat to said cold sink.

15. The refrigerated, medical dispensing drawer of claim 13 further including a central duct having openings formed in spaced relationship along the sides thereof for passing a stream of air centrally inside said chamber.

16. The refrigerated, medical dispensing drawer of claim 13 wherein said fins are sloped downward to guide condensate formed thereon by gravity to the bottom of said tub.

17. The refrigerated, medical dispensing drawer of claim 13 including two thermoelectric devices mounted in spaced-apart relationship on said rear wall of said drawer.

18. The refrigerated, medical dispensing drawer of claim 13 further including a finned air heat exchanger connected to said hot face of said thermoelectric device and extending outward from said rear wall.

19. The refrigerated, medical dispensing drawer of claim 17 further including:

a) a fan to direct a flow of ambient air against said heat exchanger: and, b) a duct to guide the air drawn in by the fan along said fins of said heat exchanger to increase the residence time thereagainst and promote a greater transfer of heat thereto.

20. The refrigerated, medical dispensing drawer of claim 13 wherein said tub is defined by a base surrounded by a pair of spaced-apart, upstanding side walls an upstanding rear wall and an upstanding front wall spaced-apart therefrom, said walls joined together along their respective intersecting marginal edges, and said cooling system further includes:

a) an aperture formed in said base of said tub below said cold sink, said slot leading outward therefrom; and, b) a liquid collecting vessel located below said slot for receiving condensed water falling through said slot from said cold sink.

21. The refrigerated, medical dispensing drawer of claim 20 further including:

a) a portion of said vessel extending rearward under said tub and out under said thermoelectric device; and, b) a wick extending from said vessel upwards into said warm air stream emanating from said hot face of said thermoelectric device to remove the condensate from said vessel by evaporation.

22. The refrigerated, medical dispensing drawer of claim 13 further including a baffle to remove the hot, moisture laden air from the hot face of said thermoelectric device, said baffle comprising:

a) a short, lateral base wall extending outward from the rear surface of said station and located inboard of said heat exchanger fins;

b) a pair of spaced-apart, upstanding baffle side walls connected to the terminal ends of said base wall and extending in divergent directions upward from said base wall toward the top of said station; and, c) a plate covering over said base wall and said side walls to form an enclosed duct with an open top for venting air therefrom.

23. A refrigerated, medical dispensing drawer for use in a computerized medicine-dispensing station, said station of the type having a cabinet that houses a plurality of openable drawers in stacked arrangement containing pharmaceutical items in locked storage therein for retrieval following instructions inputted into a computer integrated the station, said drawer comprising:

a) a drawer including a base plate, spaced-apart side walls, and spaced-apart front and rear walls, all attached together along their respective mating marginal edges to define an interior compartment of a size and shape available for reciprocal movement on a pair of side rails into and out of the cabinet;

b) a tub reposed in said drawer covered by a tub lid hingedly attached to said drawer to form an air-tight chamber interior thereof and moveable with said drawer into and out of the cabinet;

c) a plurality of individual baskets, each formed of fenestrated side walls and a bottom plate joined along their respective mating marginal edges, arranged in said tub with their open tops aligned below like-sized openings formed in said tub lid and covered over with openable basket lids held in locked engagement with said tub lid;

d) a cooling system powered by a thermoelectric device for cooling the interior and contents of said chamber and maintaining a cool temperature therein, said system completely moveable with said drawer as it is inserted and withdrawn from the cabinet; and, e) means for continually removing all condensate from the interior of said chamber.

24. The refrigerated, medical dispensing drawer of claim 23 further including:

a) a cold funnel attached to the cold face of the thermoelectric device and extending inward to said chamber;

b) a cold sink attached to said cold funnel and including fins extending outward therefrom; and, c) a fan located interior said chamber for blowing air laterally across said fins to transfer heat to said cold sink.

25. The refrigerated, medical dispensing drawer of claim 23 further including a central duct having openings formed in spaced relationship along the sides thereof for passing a stream of air centrally inside said chamber.

26. The refrigerated, medical dispensing drawer of claim 23 wherein said cooling system recirculates the air inside said chamber and does not draw in ambient air.

27. The refrigerated, medical dispensing drawer of claim 23 wherein said fins are sloped downward to guide condensate formed thereon by gravity to the bottom of said tub.

28. The refrigerated, medical dispensing drawer of claim 23 including two thermoelectric devices mounted in spaced-apart relationship on said rear wall of said drawer.

29. The refrigerated, medical dispensing drawer of claim 23 further including a finned air heat exchanger connected to said hot face of said thermoelectric device and extending outward from said rear wall.

30. The refrigerated, medical dispensing drawer of claim 29 further including:

a) a fan to direct a flow of ambient air against said heat exchanger: and, b) a duct to guide the air drawn in by the fan along said fins of said heat exchanger to increase the residence time thereagainst and promote a greater transfer of heat thereto.

31. The refrigerated, medical dispensing drawer of claim 23 wherein said tub is defined by a base surrounded by a pair of spaced-apart, upstanding side walls an upstanding rear wall and an upstanding front wall spaced-apart therefrom, said walls joined together along their respective intersecting marginal edges, and said means for removing the condensate from said chamber includes:

a) an aperture formed in said base of said tub below said cold sink, said slot leading outward therefrom; and, b) a liquid collecting vessel located below said slot for receiving condensed water falling through said slot from said cold sink.

32. The refrigerated, medical dispensing drawer of claim 31 wherein said means further includes:

a) a portion of said vessel extending rearward under said tub and out under said thermoelectric device; and, b) a wick extending from said vessel upwards into said warm air stream emanating from said hot face of said thermoelectric device to remove the condensate from said vessel by evaporation.

33. The refrigerated, medical dispensing drawer of claim 23 further including a baffle to remove the hot, moisture laden air from the hot face of said thermoelectric device, said baffle comprising:

a) a short, lateral base wall extending outward from the rear surface of said station and located inboard of said heat exchanger fins;

b) a pair of spaced-apart, upstanding baffle side walls connected to the terminal ends of said base wall and extending in divergent directions upward from said base wall toward the top of said station; and, c) a plate covering over said base wall and said side walls to form an enclosed duct with an open top for venting air therefrom.

* * * * *